United States Patent [19]

Enomoto et al.

[11] 4,425,494

[45] Jan. 10, 1984

[54] HEAT ROLLER FIXING UNIT

[75] Inventors: Masayuki Enomoto; Kiyoshi Kanai, both of Hachioji, Japan

[73] Assignee: Konishiroku Photo Industry Co., Ltd., Tokyo, Japan

[21] Appl. No.: 271,533

[22] Filed: Jun. 8, 1981

[30] Foreign Application Priority Data

Jun. 30, 1980 [JP] Japan ..... 55-91632[U]

[51] Int. Cl.[3] ..... H05B 1/02

[52] U.S. Cl. ..... 219/216; 219/471; 355/14 E; 432/60

[58] Field of Search ..... 219/216, 388, 469, 470, 219/471; 432/60; 355/3 R, 3 FU, 14 E; 118/60

[56] References Cited

U.S. PATENT DOCUMENTS

| | | | |
|---|---|---|---|
| 3,945,726 | 3/1976 | Ito et al. | 355/3 R |
| 4,001,545 | 1/1977 | Wada et al. | 219/216 |
| 4,079,227 | 3/1978 | Takiguchi | 219/216 |
| 4,163,892 | 8/1979 | Kamatsu et al. | 219/216 |
| 4,197,445 | 4/1980 | Moser | 219/216 |
| 4,254,732 | 3/1981 | Moser | 219/216 X |
| 4,297,562 | 10/1981 | Kamogawa et al. | 219/216 |

*Primary Examiner*—Volodymyr Y. Mayewsky
*Attorney, Agent, or Firm*—Jordan B. Bierman; Linda Bierman; C. Cornell Remsen, Jr.

[57] ABSTRACT

In electrostatic recording apparatus of the type in which a toner image is applied to a transfer medium such as paper, the transferred image is fixed as by passing the paper between a heated roller and a pressure roller. The present invention temporarily raises the temperature of the heated roller only during the fixing and copying operation to compensate for the heat loss to the paper and pressure roller. Thus proper fixing of the image is assured with a minimum expenditure of energy.

3 Claims, 4 Drawing Figures

HEAT ROLLER FIXING UNIT

BACKGROUND OF THE INVENTION

1. Field of the Invention

The present invention relates to a heat fixing unit having a temperature control means, for electrostatic recording apparatus or the like.

2. Description of the Prior Art

Generally, in the electrostatic recording apparatus or the like, toner image (powder image) is transferred from a charge receptor such as photoconductive member or the like onto a transfer medium such as paper, and the said toner image on the transfer medium is heated and fixed, and thus a copied image is obtained.

As a heat fixing unit in this electrostatic recording apparatus, a radiation type fixing unit that irradiates infrared rays, and a roller type fixing unit of contact heating system that utilizes thermal conduction are available, and the roller fixing unit has been widely used recently because the thermal efficiency thereof is high and consequently the electric power consumed is small; and also a speed-up of the recording apparatus is possible.

The aforesaid type of roller fixing unit is composed, in most cases, of a heat roller having a heat means (a heater lamp) at the center thereof, and of a pressure roller covered by an elastic substance such as silicon rubber or the like that makes pressure contact with said heating roller; a transfer medium to which toner images are transferred passes through these two rollers, and then said toner images in contact with the heating roller and are heated, to thus effect fixing. The driving device for both rollers of this roller fixing unit is generally disconnected for the period other than the fixing operation for the reason that it produces noise and for the additional reason of reducing electric power consumption. Furthermore if the pressure roller is held in contact with the heating roller for too long a period, material such as silicon rubber or the like that forms the surface of the pressure roller contacting the heating roller is sometimes deformed by heat. For such reason, both rollers are positioned with a clearance for the period when the transfer medium does not pass so that neither roller is deformed.

Therefore, in the roller fixing unit, there is a necessity for a so-called warming-up (WU) wherein a certain period of time is required from the start of energizing the heater up to the moment when the temperature sufficient for fixing is obtained. Immediately after this warming-up, the heat roller is hot but the pressure roller is in a state such that it is slightly warmed up only by the radiation of the heat roller during the warming-up. Consequently, if copying is made under such condition, the pressure roller contacts with the heating roller and the heat of the heating roller is used for the temperature rise on the pressure roller without being used for heating and fixing of toners on the transfer medium; thus the copying in the initial stage of operation is sometimes accompanied with an insufficient fixing.

Heretofore, as a countermeasure to solve this drawback, a method has been proposed to hold the established temperature of the heat roller high for a certain period of time immediately after the warming-up, thereby anticipating the amount of the heat to be carried away to the pressure roller, and a method to heat the pressure roller by arranging the heating means thereon separately from the heat roller and the like has also been known. However, in the method to hold the established temperature of the heating roller high, the heat resistance of the mechanism including the heat roller falls and the method to apply the separate heating means to the pressure roller has defects in that the structure thereof is complex and expensive.

SUMMARY OF THE INVENTION

The inventor of the present invention, after clarifying that the paper suffers an insufficient fixing when the copying is made immediately after the warming-up as a result of various studies on the case of insufficient fixing, invented the present invention with the object to offer a simple and inexpensive temperature control device with which the fixing immediately after the warming-up can be done sufficiently, and offers a heat roller fixing unit which comprises, a fixing roller, a pressure roller, a temperature control means for detecting surface temperature of said fixing roller, and a means for heating a certain period of time up to the temperature higher than that for heat control of said fixing roller, when a signal for the start of copying is received within the initial period when heating itself enters the control stage.

DETAILED DESCRIPTION OF THE PREFERRED EMBODIMENTS

Figure 1:
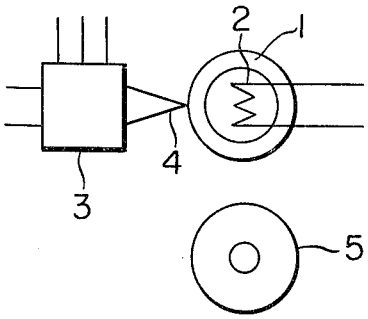
FIG. 1 diagrammatically represents an example of a heat roll fixing unit according to the present invention.

FIG. 1 represents the heat fixing unit of the present invention. The numeral 1 is a heat roller having a heater lamp 2 therein and it rotates in one direction for the fixing operation. The numeral 3 is a temperature control device and the ON or OFF circuit of the heater lamp 2 is controlled by the surface temperature of the heat roller 1 detected by the temperature detecting element 4 that keeps in touch with the surface of the heat roller 1, and thus the temperature control is made. The numeral 5 is a pressure roller and the surface thereof is composed of the elastic substance such as silicon rubber and the like, and as is well known in the art the structure thereof allows it to make a pressure contact with the heat roller 1 for fixing operation.

Figure 3:
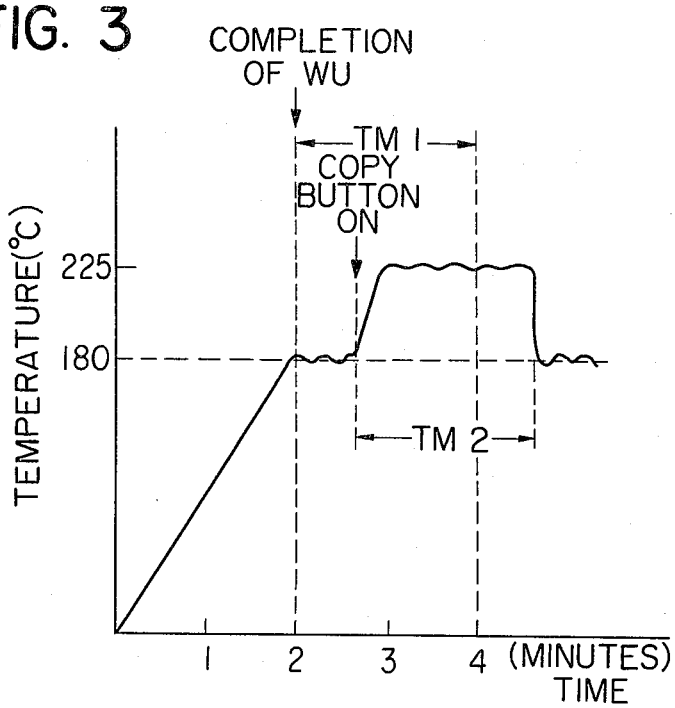
FIG. 3 shows the curve of the surface temperature of the heat roller in the present invention.
Figure 4:
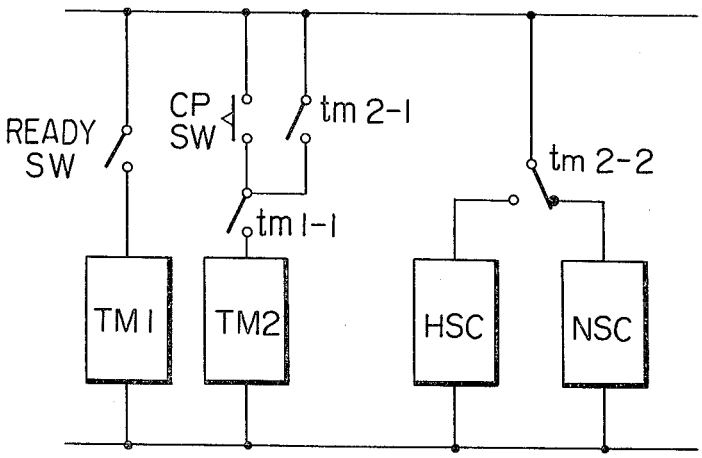
FIG. 4 is an electric circuit exemplary of the present invention.
Figure 2:
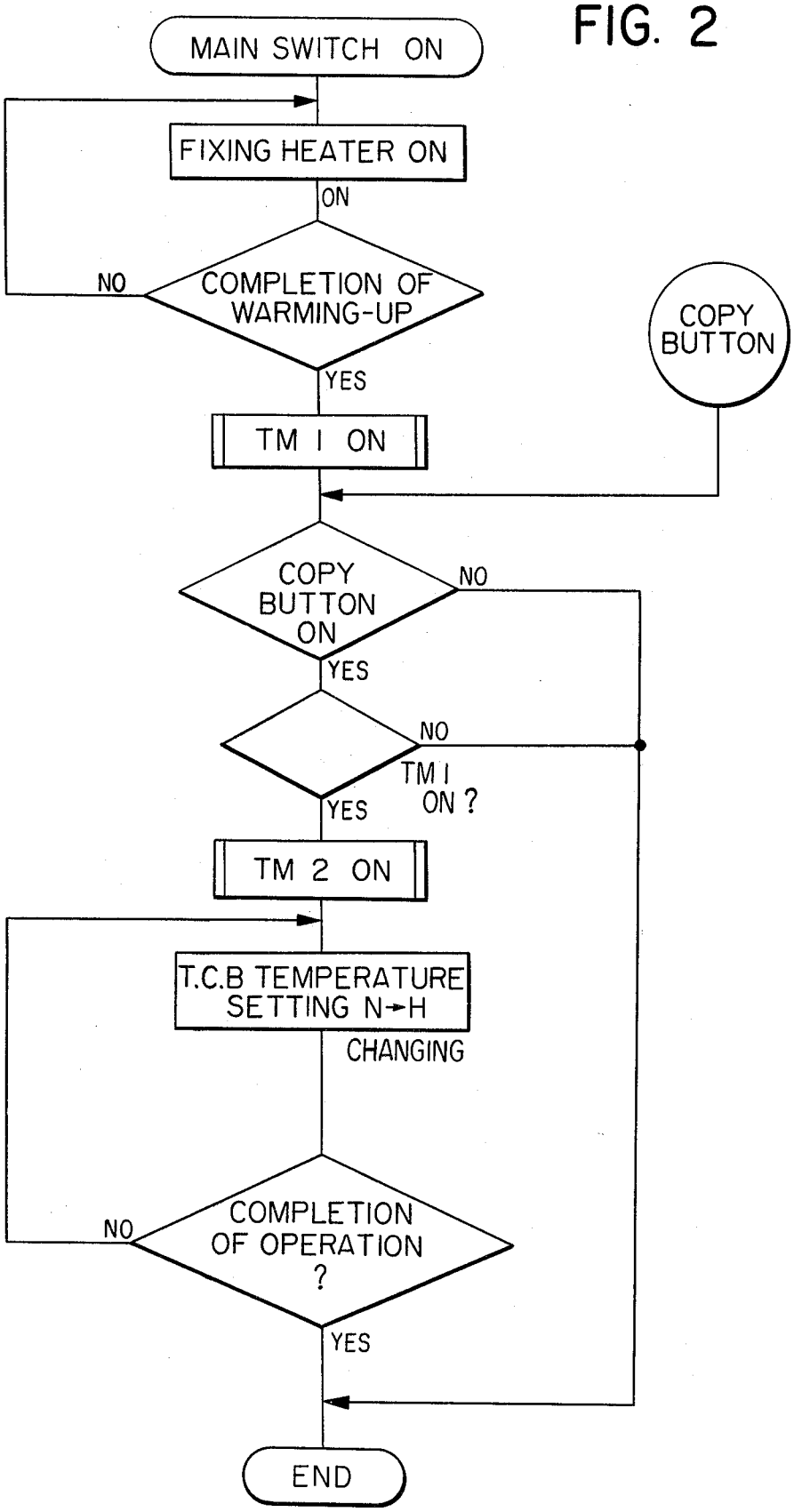
FIG. 2 shows operations of an sequence of the example of the present invention.

FIG. 2 shows a sequence of operations in an example of the present invention. When the main switch is turned on, the fixing heater (HEATER) is turned on and when the standard established temperature (N) is obtained, the warming-up is completed and the timer TM1 is actuated simultaneously with a READY signal. The operation time of TM1 is set for a time that has the possibility of an insufficient fixing. Now, if the copying is to be made during the operation of TM1, the timer TM2 operates simultaneously with the copy button and the established temperature is switched from the standard temperature (N) to a high temperature (H). Incidentally, the timer TM2 decides the time for the H temperature establishment, and it is set to include the time for the transfer medium to arrive at the fixing unit plus the time during which the pressure roller contacts the heat roller and the temperature detecting part 4 detects the resulting temperature fall of the heat roller 1; the heater lamp 2 then is lit causing the surface temperature of the heat roller 1 to start rising. The heater lamp 2 lights simultaneously with the established temperature to be switched to H and the temperature of the heat roller 1 rises up to the established temperature H and the heat is restored. Therefore, it is possible to maintain the temperature of the heat roller to the extent that toner images on the transfer medium can fully be melted and fixed even if the heat is carried way by the pressure roller. FIG. 3 shows the graph for the surface temperature of the heat roller 1 obtained when the copy button was pushed during the operation of the timer TM1 after the completion of the warming-up. FIG. 4 is a circuit diagram that illustrates the sequence described in FIG. 2. By turning READY switch (SW) on, the timer TM1 is turned on and then the contact tm 1-1 is closed. The timer TM1, after the completion of the established time thereof, will return to the OFF state. Now, if the copy button (CP SW) is turned on, the timer TM2 is turned on and then tm 2-1 is closed, thus the timer TM2 holes the power source itself. During the course of ON of the timer TM2, the circuit for H establishment (Hsc) is operated with the aid of tm 2-2 and when the established time of the timer TM2 is completed. The circuit then is switched from H establishment circuit (Hsc) to N establishment circuit (Nsc) with the aid of tm 2-2.

In the present invention, as stated above, the temperature for heat fixing is controlled with the standard established temperature (N) in the case the copying is not made immediately after the warming-up and even when the copying is made right after the warming-up, the durability of mechanism in the apparatus will not be reduced due to the fact that the period of high temperature is extremely short and the structure is simple and inexpensive because only the timer function and high temperature (H) establishment function are necessary to be added to the temperature control circuit and the complicated added mechanism such as the heat means for the pressure roller etc. is not necessary.

Further, unlike the conventional method to heat at high temperature in the initial stage even when copying is not made, in the present invention heating at high temperature in the initial stage is made only when the copying is made. Therefore, even if the heating is made at high temperature, the heat itself is absorbed in the transfer medium with the result that other mechanisms do not suffer an abnormal heating was observed.

As a variation of the present invention, there is a method wherein the copy signal is taken from the copy button or from the machine side in place of the timer 2 (TM2) and the high temperature (H) is switched to the standard established temperature (N) in accordance with the number of copies and this method is naturally included in the present invention.

What is claimed is:

1. In an electrostatic recording apparatus of the type in which a toner image is impressed upon a transfer medium and fixed thereon to provide copies by passing said medium between the heat roller having a feeding element to provide a normal fixing temperature, and a pressure roller, and in which said recording apparatus includes a main power switch and a copy button for initiating the copying action, the improvement comprising means detecting the heat on the surface of said heat roller, control means responsive to said detecting means for energizing or deenergizing said heating element to maintain a desired surface temperature of said heat roller, means responsive to actuation of said main power switch operating through said control means for energizing said heating element to warm up said heat roller to said desired surface temperature, a first timer switch operative upon said control means for controlling the energization and deenergization of said heating element for a predetermined time period after said heat roller has been warmed to maintain said desired surface temperature of said heat roller, a second timer switch adapted to be actuated by said copy button during said first predetermined time period, means responsive to said second timer switch and operating through said control means for controlling energization and deenergization of said heating element to produce on the surface of said heat roller for a second predetermined time period of a duration sufficient to include the fixing and copying operations, a temperature higher than said first desired temperature, and means deactivating said second timer switch at the expiration of said second predetermined time period.

2. In an electrostic recording apparatus, the improvement according to claim 1, in which said first desired temperature is a normal fixing temperature, and in which said higher temperature is sufficiently greater than said normal fixing temperature to compensate for the heat loss arising during the fixing and copying operation to thereby insure a normal fixing temperature during said operation.

3. In an electrostatic recording apparatus, the improvement according to claim 2, in which said first predetermined time period is of a duration insufficient to include the fixing and copying operation.

* * * * *